United States Patent [19]

Dörr et al.

[11] 4,330,900

[45] May 25, 1982

[54] VACUUM CLEANER WITH FILLING-CONDITION INDICATOR

[75] Inventors: Manfred Dörr, Bochum; Georg Haase, Radevormwald; Paul-Ulrich Uibel, Ennepetal, all of Fed. Rep. of Germany

[73] Assignee: Vorwerk & Co. Interholding GmbH, Wuppertal, Fed. Rep. of Germany

[21] Appl. No.: 157,634

[22] Filed: Jun. 6, 1980

[30] Foreign Application Priority Data

Jun. 6, 1979 [DE] Fed. Rep. of Germany ..... 2922857

[51] Int. Cl.[3] ..... A47L 9/19

[52] U.S. Cl. ..... 15/339; 55/274; 55/DIG. 34; 116/268

[58] Field of Search ..... 15/339; 55/274, DIG. 34; 116/268, 270

[56] References Cited

U.S. PATENT DOCUMENTS 4,070,170 1/1978 Leinfelt ..... 15/339 X 4,195,383 4/1980 Leinfelt ..... 15/339

FOREIGN PATENT DOCUMENTS 401195 11/1933 United Kingdom ..... 15/339

*Primary Examiner*—Chris K. Moore

*Attorney, Agent, or Firm*—Michael J. Striker

[57] ABSTRACT

A vacuum cleaner has a housing with an inlet which can be closed by a cover. A dust bag can be installed in the housing suspended from a plate which is located inwardly of the cover and has two openings both of which communicate with the interior of the bag. The cover carries a suction nipple which sealingly enters one of the openings when the cover is closed. A connecting nipple is also carried by the cover and sealingly enters the other opening when the cover is closed. The entire connecting nipple, or a diaphragm mounted in the same, moves in direction towards the cover when, in response to increasing filling of the bag and clogging of the filter pores thereof, the pressure in the bag rises to a level higher than the pressure at the other side of the connecting nipple or diaphragm, respectively. This movement is transmitted to an indicator observable from the exterior of the vacuum cleaner and provides an indication of the degree to which the bag is filled.

12 Claims, 3 Drawing Figures

VACUUM CLEANER WITH FILLING-CONDITION INDICATOR

BACKGROUND OF THE INVENTION

The present invention relates to a vacuum cleaner.

More particularly, the invention relates to a vacuum cleaner of the type having replaceable filter (i.e., dust) bags.

Still more specifically, the invention relates to a vacuum cleaner having an indicator which informs a user of the extent to which the filter bag is filled with dust and the like.

Vacuum cleaners with filling-condition indicators are already known. In these the carrier plate to which the replaceable filter bag is secured, has two openings of which one communicates with the suction intake of the vacuum cleaner. The paper of the filter bag extends across the other opening and is interposed between the same and a conduit leading to the pressure-responsive filling-condition indicator. This has two inherent disadvantages: a proper seal between the open end of the conduit and the filter paper of the dust bag is difficult to establish so that ambient air may be drawn into the line and lead to incorrect filling-condition indications, and the open end of the conduit must be in exact registry with the carrier-plate opening which requires considerable precision (and attendant costs) in the manufacture of the parts involved.

SUMMARY OF THE INVENTION

It is, accordingly, an object of the invention to avoid the disadvantages of the prior art.

A more particular object is to avoid these disadvantages in a simple but effective manner without appreciably increasing the manufacturing expenses of a vacuum cleaner embodying the invention.

Pursuant to the above objects, and still others which will become apparent hereafter, one aspect of the invention resides in a vacuum cleaner comprising, in combination, a housing having a bag-admitting opening; a filter-bag supporting plate mounted in the housing inwardly of said bag-admitting opening and having two openings communicating with the interior of a supported filter bag; a cover on the housing movable between an open and a closed position in which it respectively exposes and closes the bag-admitting opening, the cover having a suction-nipple and a connecting nipple each of which enters into one of the openings when the cover moves to the closed position; and bag-filling condition indicator means communicating with the connecting nipple.

From the above it will be seen that an important advantage of the invention resides in the fact that the tubular connecting nipple for the filling-condition indicator enters into the second opening of the bag-supporting plate and is automatically sealed with reference to the suction chamber. The invention thus makes it possible to compensate in a simple but effective manner for deviations from manufacturing and/or mounting tolerances. Precision manufacture and precision mounting of the components involved is no longer necessary.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
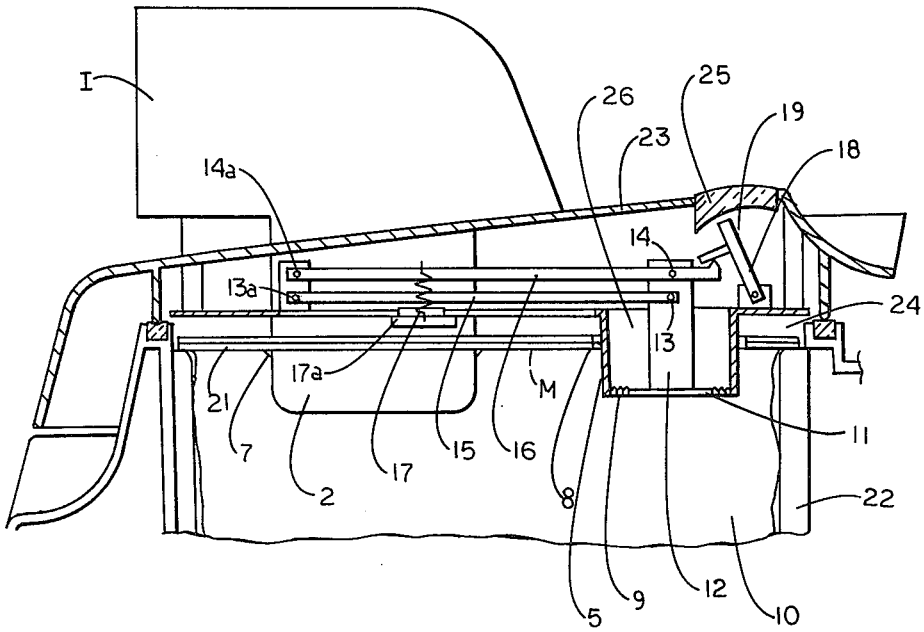
FIG. 1 is a fragmentary cross-section of a vacuum cleaner embodying the invention.
Figure 2:
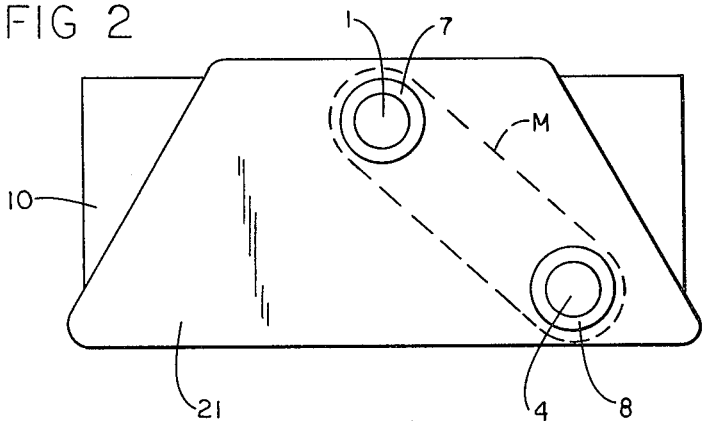
FIG. 2 is a top plan view of the carrier plate shown in FIG. 1, with a filter bag depending from it.

An exemplary embodiment of the invention is shown in FIGS. 1 and 2 which illustrate only so much of an otherwise known-per-se vacuum cleaner as relates to, and is necessary for an understanding of, the present invention.

The housing 22 of the vacuum cleaner is fragmentarily illustrated. A conventional carrier plate 21 is provided (cf. FIG. 2) from which a filter-paper dust bag 10 is suspended, again in known manner. The plate and bag are inserted into the housing 22 and a cover 23 is then closed over the opening through which they have been inserted. The cover 23 carries two tubular nipples 2 and 5; the nipple 2 communicates with the external suction intake I of the housing whereas nipple 5 is simply open to the underside of the cover 23. Plate 21 is provided with two openings 1 and 4 (compare FIG. 2) into which the nipples 2 and 5 enter as the cover 23 is being closed.

One side of plate 21, e.g., the side which faces away from the cover, is provided with an elastically compressible sealing member M (see the broken line in FIG. 2) of e.g., synthetic plastic closed-cell foam material which forms seals 7 and 8 about the openings 1 and 4, respectively. The seals 7, 8 are so dimensioned that they are sealingly engaged by the nipples 2, 5 as the same enter into the openings 1, 4 in response to closing of the cover 23. In other words: closing of the cover automatically seals the suction chamber 24 with reference to the interior of the filter bag 10. The seals 7, 8 could of course be separate members, but the use of a one-piece member M simplifies the construction and assembly further.

The nipple 5 cooperates with a filling-condition indicator which indicates to a user to what extent the bag 10 is filled, i.e., whether it is time as yet to replace the bag with an empty one. For this purpose the cross-section of nipple 5 is spanned by a flexible diaphragm 9 carrying a rigid center portion 11 from which a rigid member 12 extends inwardly of the nipple 5. A pair of parallel arms 15, 16 is located in the cover 23; the one ends of these arms are pivoted to the member 12 at 13, 14 whereas their other ends are pivoted to the cover at 13*a*, 14*a*. A spring 17 has one end connected to a stationary connector 17*a* which is slidable along a portion of the cover, lengthwise of the arms 15, 16; its other end is connected to (e.g., hooked over) the arm 16. In addition, the spring is also connected to arm 15, so that it yieldingly draws both arms towards the plate 21 when a counterforce acts via the diaphragm 9 and the part 12 due to a pressure differential. The force exerted by spring 17 can be varied by sliding the connector 17*a* and the spring lengthwise of the arms 15, 16.

The rigid member 12 abuts a pivotable angled lever 18 which operates as a drag pointer or maximum-position indicator. The drag pointer is generally a construction which is within the purview of a socalled "person of ordinary skill". Conceivable is a follow-up pointer analogous to that of a barometer with the resetting effect herein being achieved by opening and closing of the cover during filter changes; i.e., it always remains in the respectively assumed pivoted position until it is forcibly returned to its zero position which, in the present embodiment, is effected when the cover 23 is moved to open position. A window 25 set into the cover 23 permits the position of lever 18 to be observed from the exterior of the vacuum cleaner.

The operation of the filling-condition indicator is as follows:

When the bag fills with dust the pores in its filter paper gradually become clogged. This causes the pressure in the bag 10 to rise to a level higher than that in the suction chamber 24 which communicates with the space 26 above diaphragm 9—also higher than in the space 26. The diaphragm 9 therefore flexes upwardly in FIG. 1, i.e., into the nipple 5, causing member 12 to move upwardly and to pivot lever 18 in a clockwise direction. This can be observed through window 25; in fact, even when the vacuum cleaner is not in operation the last displaced position of the lever 18 can be observed since the lever 18 remains in the farthest-right position which it reaches until the cover 23 is opened and lever 18 thereby reset.

By shifting connector 17*a* and spring 17 lengthwise of the arms 15, 16 the degree of clockwise displacement of lever 18 can be coordinated with the filling condition in bag 10, i.e., with the pressure differentials resulting from different degrees of filling of the bag. This setting can be effected at the factory and the window 25—or another part of the cleaner—may be provided with markings (e.g., a scale) with which the lever 18 cooperates to indicate the degree to which bag 10 is filled.

Figure 3:
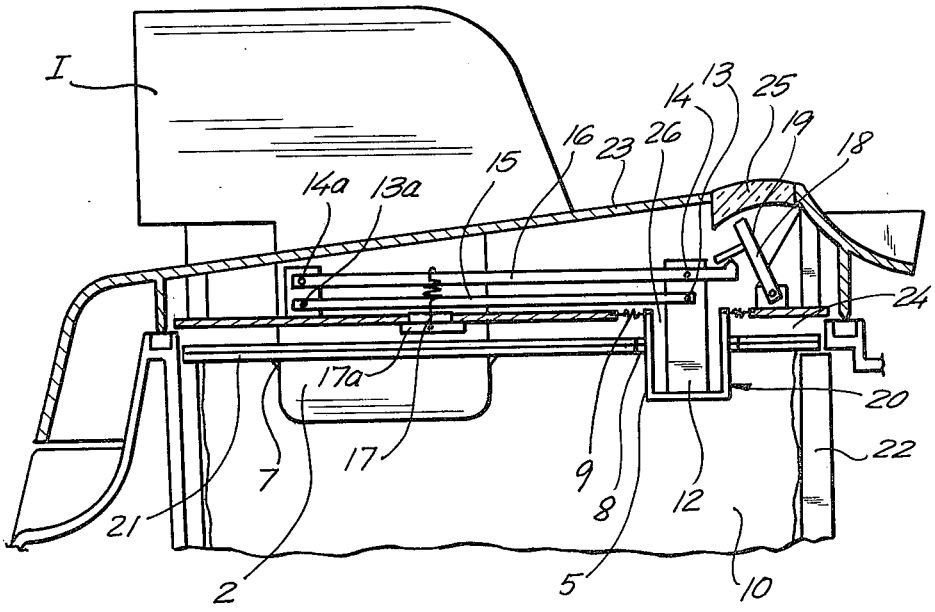
FIG. 3 is a view similar to FIG. 1 but slowing a modification.

In place of the diaphragm 9 and member 12 it could be the entire nipple 5 which is slidable towards window 25 to pivot the lever 18; the arms 15, 16 could then be directly pivoted to nipple 5. It is understood that the diaphragm 9 would then have to be replaced by a rigid transverse wall, or else the nipple could be constructed like a piston, i.e., with two rigid transverse walls at its opposite ends. This is shown in FIG. 3 which is otherwise identical with FIG. 1 and to that extent requires no specific description. In FIG. 3, however, the diaphragm 9 is connected at its outer periphery to the inner wall of cover 23 and at its view periphery to the nipple 5 adjacent the upper end thereof. The nipple 5 is thus closed at its lower end and slidable in the manner of a piston in the opening 4 of plate 21.

While the invention has been illustrated and described as embodied in a vacuum cleaner, it is not intended to be limited to the details shown, since various modifications and structural changes may be made without departing in any way from the spirit of the present invention.

Without further analysis, the foregoing will so fully reveal the gist of the present invention that others can, by applying current knowledged, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a vacuum cleaner, a combination comprising a housing having a suction chamber and a bag-admitting opening; a filter bag supporting plate mounted in said housing inwardly of said bag-admitting opening and having two openings communicating with the interior of a supported filter bag in which pressure increases as the bag is filled with dust; a cover on said housing movable between an open and a closed position in which it respectively exposes and closes said bag-admitting opening, said cover having a suction-nipple entering in one of said openings and a connecting nipple entering into another of said openings and communicating with said suction chamber when said cover moves into said closed position; and bag-filling condition indicator means including a member in said connecting nipple operative in response to pressure differentials between said suction chamber and the interior of said bag.

2. A combination as defined in claim 1, said plate further comprising an elastically compressible seal extending circumferentially of each of said openings in said plate.

3. A combination as defined in claim 2, said seals both being parts of a single sealing member.

4. A combination as defined in claim 1, said member being a flexible diaphragm extending transversely of its free cross-section and subject to deformation in response to the development of pressure differentials at opposite sides of the diaphragm.

5. A combination as defined in claim 4, said diaphragm having one side facing towards and another side facing away from the filter bag; said indicator means further comprising a rigid member carried by said other side and movable with the diaphragm when the same flexes, and a pair of parallel arms having first end portions pivoted to said rigid member and second end portions pivoted to a stationary portion of the vacuum cleaner.

6. A combination as defined in claim 5, the indicator means further comprising spring means biasing said arms and said rigid member in a direction towards said filter bag.

7. A combination as defined in claim 6, said spring means including a biasing spring and a connector, one end of said spring being connected to said connector which is movable lengthwise of said arms to vary the biasing force acting upon the arms.

8. A combination as defined in claim 5, said indicator means further comprising an angled lever pivotably mounted in said vacuum cleaner, an extension of a first end portion of one of said arms abutting a portion of said lever to pivot the same in response to flexing of said diaphragm.

9. A combination as defined in claim 8, said angled lever being a drag pointer.

10. A combination as defined in claim 1, said member being integrally formed with said connecting nipple and forming a piston movable relative to said plate in response to pressure differentials acting upon opposite ends of said piston.

11. A combination as defined in claim 10, said piston being spring-biased in a direction towards said filter bag.

12. A combination as defined in claim 10; said indicator means further comprising a pivoted angled lever a rigid member carried on the side of said piston away from the filter bag, and a pair of parallel arms having first end portions pivoted to said rigid member and second end portions pivoted to a stationary portion of said vacuum cleaner, an extension of a first end portion of one of said arms abutting said lever to pivot the same in response to shifting of the piston due to said pressure differentials.

* * * * *